United States Patent [19]

Kostelitz

[11] 4,322,255

[45] Mar. 30, 1982

[54] HEAT TREATMENT OF STEEL AND METHOD FOR MONITORING THE TREATMENT

[75] Inventor: Michel Kostelitz, Versailles, France

[73] Assignee: L'Air Liquide, Societe Anonyme pour l'Etude et l'Exploitation des Procedes Georges Claude, Paris, France

[21] Appl. No.: 107,785

[22] Filed: Dec. 28, 1979

[30] Foreign Application Priority Data

Jan. 15, 1979 [FR] France ..... 79 00872

[51] Int. Cl.[3] ..... C21D 1/48

[52] U.S. Cl. ..... 148/16.5; 148/16.6; 148/16.7

[58] Field of Search ..... 148/16.5, 16.6, 16.7, 148/16.0, 31.5

[56] References Cited

U.S. PATENT DOCUMENTS

| | | | |
|---|---|---|---|
| 3,011,873 | 12/1961 | Davis | 148/16.5 |
| 3,240,636 | 3/1966 | Daubersy | 148/16.5 |
| 3,693,409 | 9/1972 | Yamagishi | 148/16.5 |
| 3,946,817 | 3/1976 | Prince | 148/16.5 |
| 4,035,203 | 7/1977 | L'Hermite et al. | 148/16.5 |
| 4,049,472 | 9/1977 | Arndt | 148/16.5 |
| 4,145,232 | 3/1979 | Solomon | 148/16.5 |
| 4,154,629 | 5/1979 | Asai et al. | 148/16.6 |
| 4,175,986 | 11/1979 | Ewalt et al. | 148/16.5 |
| 4,188,242 | 2/1980 | Scales | 148/16.5 |
| 4,208,224 | 6/1980 | Girrell | 148/16.5 |
| 4,211,584 | 7/1980 | L'Hermite et al. | 148/16.7 |

FOREIGN PATENT DOCUMENTS

| | | |
|---|---|---|
| 78-2403 | 4/1978 | South Africa . |
| 1471627 | 4/1977 | United Kingdom . |

OTHER PUBLICATIONS

Metals Handbook, vol. 2, American Society for Metals, 1964, pp. 104–106.

*Primary Examiner*—John P. Sheehan
*Attorney, Agent, or Firm*—Lee C. Robinson, Jr.

[57] ABSTRACT

The present invention relates to improvements in processes for treatment of steel under a controlled atmosphere.

Use is made of an atmosphere formed by a carrier gas comprising or containing industrially pure nitrogen and by an active gas formed by a hydrocarbon such as: $CH_4$, $C_4H_{10}$, $C_3H_8$, $C_2H_4$, $C_2H_2$, $C_2H_6$, and by carbon monoxide fed in under the form of pure gas or obtained by decomposition of methanol, the treatment being performed between 750° and 1150° C.

The invention is applicable to heating prior to hardening, to annealing, to carburization and to carbo-nitriding of steels.

8 Claims, No Drawings

HEAT TREATMENT OF STEEL AND METHOD FOR MONITORING THE TREATMENT

BACKGROUND OF THE INVENTION

The present invention relates essentially to a process for heat treatment of steel, such as heating prior to tempering, annealing, cementation or case-hardening (carburization or carbo-nitriding) performed within a furnace in the presence of an atmosphere under constant flow obtained by mixing a carrier gas including nitrogen and if appropriate hydrogen, with an active gas formed by a hydrocarbon with a volumetric proportion of hydrocarbon comprised between 0.2 and 30% of the mixture.

The application of this known process may raise particular difficulties, especially in the case of case-hardening workpieces comprising deep bores or else of workpieces of complex shape. Small deposits of soot deleterious to the quality of the finished product may actually be produced at the bottom of these bores or of other hollow sections which are difficult to reach.

An object of the present invention is to avert or minimise the aforesaid difficulties and to allow a case hardening action which is homogenous and free of soot, even on workpieces reputed to be difficult.

The experiments performed in seeking this result rendered it possible to find that the function of carbon monoxide is of prime importance in the transfer of carbon atoms from the atmosphere to the metal. As a matter of fact, the carbon monoxide renders it possible to perform a case-hardening action on the surface of the metal workpiece by a double-layer effect. The carbon monoxide is absorbed in the form of a metallic carbon-metal composite, rendering it possible to cover the entire surface, even in the least accessible parts, of the workpieces reputed to be difficult, such as those comprising deep bores, or in the cavities of workpieces of complex shape. The hydrocarbon present in the atmosphere may then form a double layer by a bond with the carbon monoxide radicals absorbed. This results in a continuous passage of the carbon atoms thus carried by the double layer, which allows of homogenous case-hardening throughout the parts of the workpieces treated.

Experience has also shown that it is important to eliminate any trace of residual oxygen from the atmosphere, so as to prevent a destabilisation of the aforesaid double layer. As a matter of fact, the oxygen molecules cause the forming around them of nucleii of hydrocarbons in the gaseous phase and by virtue of this fact prevent the double layer formed at the metal surface from being supplied with hydrocarbon, which is shown by areas insufficiently rich in carbon on the workpieces, that is to say heterogeneities in case-hardening It is known moreover that standard industrial nitrogen contains appreciable quantities (apt to reach 2%) of oxygen, carbon dioxide and steam, and experience has also shown that it is this oxygen fed in directly by standard industrial nitrogen, or originating from the decomposition of the carbon dioxide or steam it carries, which destabilises the double layer described above.

SUMMARY OF THE INVENTION

The aforesaid object is accomplished by the process in accordance with the present invention, essentially by virtue of the fact that the said atmosphere is produced by mixing the aforesaid carrier gas, formed by nitrogen or containing nitrogen, having a proportion of $O_2$ less than 10 ppm, a proportion of water less than 10 ppm and a proportion of carbon dioxide less than 10 ppm, with a hydrocarbon selected from the following compounds: $CH_4$, $C_4H_{10}$, $C_3H_8$, $C_2H_4$, $C_2H_2$, $C_2H_6$, and with carbon monoxide, the proportion of carbon monoxide in the overall mixture being between 0.1 and 30% by volume, and the temperature of the steel being between 750° and 1150° C.

The application of nitrogen containing a proportion of $O_2$ less than 10 ppm, a $CO_2$ content less than 10 ppm and an $H_2O$ content less than 10 ppm (which corresponds to a dew point of approximately −60° C.), that is to say nitrogen of industrial purity, ensures that an oxygen-free atmosphere is obtained; the carbon monoxide contained by this atmosphere may play its part fully, that is to say facilitate the passage into the metal of the carbon atoms of the hydrocarbons, which results in a cementation and more particularly a carburization, which is homogenous and substantially free of soot deposits, notwithstanding the configuration of the workpieces treated.

The value of the percentum proportion of carbon monoxide of the overall mixture, comprised within the range from 0.1 to 30%, is selected as a function of the characteristics of the steel of the workpiece treated, of the treatment temperature which is itself at least partly a function of the characteristics of this steel, and of the configuration of the workpiece treated, that is to say of the ratio between its overall surface area and its volume, the percentum proportion of CO having to be the greater the higher the ratio, for this last parameter.

According to another feature of the invention, the carbon monoxide may also be fed into the aforesaid mixture in the form of pure gas or else in the form of a partial mixture of nitrogen and carbon monoxide in the gaseous or liquid state.

According to yet another feature of the invention, the carbon monoxide originates from the decomposition under heat of methanol in accordance with the reaction $CH_3OH \rightarrow CO + 2H_2$, the said methanol being fed into the aforesaid mixture.

The decomposition of methanol in accordance with the aforesaid reaction is that which occurs practically exclusively within the temperature range from 700° to 1150° C., which incorporates the processing temperature range.

In the case of a carbo-nitriding operation, the atmosphere is established by mixing ammonia with the carrier gas in the volumetric proportion of 0.1 to 30%, apart from the aforesaid hydrocarbon and carbon monoxide.

Workpieces are thus obtained which are carbo-nitrided homogenously and substantially without soot deposits, notwithstanding the configuration of the workpieces treated.

The percentum value of $NH_3$ is selected as a function of the steel processed and of the required degree of nitriding.

It should be noted moreover that the fact that an atmosphere practically free of oxygen, steam and carbon dioxide gas is fed into the furnace, allows of a molecule-molecule reaction between the carbon dioxide gas or the water formed by the case-hardening reaction, and the hydrocarbon, in accordance with the following reactions (the hydrocarbon being assumed to be $CH_4$):

$$2\,CO \rightarrow C + CO_2 \qquad CO_2 + CH_4 \rightarrow 2CO + 2\,H_2$$
$$H_2 + CO \rightarrow C + H_2O \qquad H_2O + CH_4 \rightarrow CO + 3\,H_2$$

This results in very strict checks on $H_2O$, $CO_2$ and $CH_4$ at the outlet of the furnace which truly and very precisely characterize the situation of in situ carburization.

The invention also relates to a method of monitoring the heat treatment specified above, that is to say performed within a furnace in the presence of an atmosphere under constant flow, obtained by mixing a carrier gas incorporating nitrogen and if applicable hydrogen, with an active gas formed by a hydrocarbon to which CO is added.

This monitoring method is characterised by the fact that the residual proportions of hydrocarbon, steam and carbon dioxide gas in the atmosphere emerging from the furnace are measured, that the proportion of hydrocarbon in the atmosphere penetrating into the furnace which is required to obtain the desirable proportion of carbon is determined by reference to predetermined tables which specify a relationship and the proportions of carbon in the steel and the delivery of hydrocarbon penetrating into the furnace is controlled to obtain the aforesaid proportions at the outlet of the furnace and consequently the said desirable proportion of carbon.

A monitoring method of this kind thus renders it possible to control the treatment in such manner as to prevent the formation within the furnace of carbon dioxide and of steam whose presence had been carefully prevented in the atmosphere entering the furnace; consequently, it renders it possible to obtain an end product which has the characteristics required.

The invention also relates to the steels obtained by the aforesaid treatment process.

A variety of tests in respect of types of treatment (carburization, carbo-nitriding, heating prior to case-hardening) was performed on steels having different compositions, the atmospheres penetrating into the furnace commonly being formed by pure industrial nitrogen, by at least one of the aforesaid hydrocarbons, if applicable hydrogen, carbon monoxide or methanol being added to these components. In the case of a carbo-nitriding operation, the atmospheres also contained ammonia.

Regarding the treatment temperatures comprised within the aforesaid range 750° to 1150° C., it was noted that the introduction of $NH_3$ caused a reduction of the preferred temperatures into the lower part (750°–1050° C.) of the said range.

In each of these tests, the treatment was monitored by measuring the residual proportions of hydrocarbon, $CO_2$ and $H_2O$ in the atmosphere emerging from the furnace and controlling the delivery of hydrocarbon fed into the atmosphere penetrating into the furnace to obtain the required carburizing activity, that is to say by controlling the addition of hydrocarbon at the intake of the furnace. To allow of this monitoring operation, tables were compiled beforehand which establish a relationship between, on the one hand, the residual proportion of hydrocarbon, the residual proportion of $H_2O$, the residual proportion of $CO_2$ at the outlet of the furnace and, on the other hand, the quantity of carbon introduced into the steel. Perusal of these tables allows of adjustment of the carbon potential as stated above.

Some examples are given in the following regarding the tests performed, with specification in each case of the treatment performed, the substance of the steel treated, and the compositions of the atmospheres penetrating into and issuing from the furnace.

EXAMPLE 1

(Carburization)

Workpieces made of 20NCD2 steel (AFNOR standard) were treated for 4½ hours at 900° C. in a batch-type furnace into which was fed a nitrogen-hydrogen-methane-carbon monoxide atmosphere. The compositions of the atmospheres at the intake and at the outlet of the furnace were the following:

| Intake | Outlet |
|---|---|
| 47% $N_2$ | 31% $H_2$ |
| 30% $H_2$ | 18% CO |
| 8% $CH_4$ | 2% $CH_4$ |
| 15% CO | 0.17% $H_2O$ |
| | 0.08% $CO_2$ |
| | the remainder: $N_2$ |

The hardness of the carburised layer oil-hardening subsequently mounted to 60 Rockwell on scale C. The carburized depth reached 0.7 mm with 0.8% surface carbon and without residual austenite or carbides.

EXAMPLE 2

(Carburization)

Workpieces made of 16 CD4 steel (AFNOR standard) were treated for 2 hours at 900° C. in a batch-type furnace, the latter receiving a nitrogen-propane-methanol atmosphere (this latter being decomposed into carbon monoxide and hydrogen). The compositions of the intake and outlet atmospheres were the following:

| Intake | Outlet |
|---|---|
| 55% $N_2$ | 28% $H_2$ |
| 1% $C_3H_8$ | 13.7% CO |
| 44% $CH_3OH$ | 0.8% $CH_4$ |
| | 0.34% $H_2O$ |
| | 0.1% $CO_2$ |
| | the remainder: $N_2$ |

Hardness measurements performed on workpieces hardened in oil after treatment yielded values of 87 Rockwell on scale A. The depth of carburization reached 0.4 mms with 0.8% surface carbon.

EXAMPLE 3

(Carbon-nitriding)

Workpieces made of 27CD4 steel (AFNOR standard) were treated for 4 hours at 870° C. in a batch-type furnace which received an atmosphere of nitrogen-hydrogen-methane-ammonia.

The compositions of the atmospheres at the intake and outlet of the furnace were the following:

| Intake | Outlet |
|---|---|
| 59.3% $N_2$ | 28% $H_2$ |
| 22% $H_2$ | 11.6% CO |
| 7% $CH_4$ | 3.4% $CH_4$ |
| 11% CO | 0.34% $H_2O$ |
| 0.7% $NH_3$ | 0.2% $CO_2$ |
| | the remainder: $N_2$ |

Hardness measurements made on oil-hardened workpieces yielded values of 857 Vickers in HV50 g. The carbo-nitrided depth reached 0.4 mm at 650 HV1 kg.

EXAMPLE 4

(Carbo-nitriding)

Workpieces made of 38C2 steel (AFNOR standard) were treated for 3¼ hours at 890° C. in a batch-type furnace receiving an atmosphere of nitrogen-methane-methanol-ammonia.

The compositions of the atmospheres at the intake and outlet of the furnace were the following:

| Intake | Outlet |
|---|---|
| 50% $N_2$ | 29.4% $H_2$ |
| 2.5% $CH_4$ | 15% CO |
| 47% $CH_3OH$ | 1.6% $CH_4$ |
| 0.5% $NH_3$ | 0.24% $H_2O$ |
| | 0.15% $CO_2$ |
| | the remainder: $N_2$ |

Hardness measurements made on oil-hardened workpieces (hardened after being treated) yielded values of 62 Rockwell on scale C. The carbo-nitrided depth reached 0.48 mm at 650 HV1 kg. The total case-hardened depth amounted to 0.7 mm.

EXAMPLE 5

(Heating prior to hardening)

Workpieces made of 30CD4 steel (AFNOR standard) were treated for 2 hours at 850° C. in a batch-type hardening furnace, in a nitrogen-methanol atmosphere.

The compositions of the atmospheres at the intake and outlet of the furnace were the following:

| Intake | Outlet |
|---|---|
| 70% $N_2$ | 20% $H_2$ |
| 30% $CH_3OH$ | 9% CO |
| | 0.4% $CH_4$ |
| | 0.45% $H_2O$ |
| | 0.6% $CO_2$ |
| | the remainder: $N_2$ |

The workpieces hardened underwent neither carburization nor decarburization. The carbon potential of the atmosphere measured by means of a foil amounted to 0.30%C.

EXAMPLE 6

(Comparative carburization)

Tests were performed on the other hand on workpieces made of 20NCD2 steel; for 5½ hours at 900° C. with two atmospheres, one being of the type described in example 1, that is to say containing 15% of CO, the other being identical but free of CO. These workpieces had grooves or bores having a width of approximately 3 mms, and a depth equally of approximately 3 mms. The results obtained are given in the following table:

| Case-hardened depth in mm | Carburizing atmosphere without CO | Carburizing atmosphere with CO = 15% |
|---|---|---|
| Workpiece side | 1 mm | 1.1 mm |
| groove bottom | 0.6 mm | 0.85 mm |

The workpiece side carburized depth, as well as that at the groove bottom, has been increased. Furthermore, the homogeneity of the treatment is better, with a much more satisfactory relative deviation.

The invention is not limited in any way to the examples described above which were given by way of non-limiting illustration.

I claim:

1. A process for the heat treatment of steel within a furnace, comprising the steps of forming a mixture of a carrier gas, an active gas and carbon monoxide, said carrier gas including nitrogen and having a proportion of $O_2$ less than 10 ppm, a proportion of $H_2O$ less than 10 ppm and a proportion of $CO_2$ less than 10 ppm, said active gas containing a hydrocarbon in a volumetric proportion between 0.2 and 30 percent of the mixture, selected from the group of compounds consisting of $CH_4$, $C_4H_{10}$, $C_3H_8$, $C_2H_4$, $C_2H_2$ and $C_2H_6$, said carbon monoxide being present in the mixture in a volumetric proportion between 0.1 and 30 percent; continuously directing a constant flow of said mixture into said furnace; maintaining the temperature of the steel in said furnace between 750° and 1150° C.; measuring the residual contents of hydrocarbon, of steam and of carbon dioxide gas in the atmosphere issuing from the furnace; predetermining the proportion of hydrocarbon in the atmosphere penetrating into the furnace in accordance with the relationship between the residual contents of hydrocarbon, steam and carbon dioxide gas, and the proportions of carbon introduced in the steel; and controlling the delivery of hydrocarbon penetrating into the furnace in accordance with the predetermined proportion.

2. A process according to claim 1, wherein said carbon monoxide is fed into said mixture in the form of pure gas.

3. A process according to claim 1, wherein said carbon monoxide is fed into said mixture in the form of a partial nitrogen-carbon monoxide mixture in the gaseous state.

4. A process according to claim 1, wherein said carbon monoxide is fed into said mixture in the form of a partial nitrogen-carbon monoxide mixture in the liquid state.

5. A process according to claim 1, wherein said carbon monoxide originates from the decomposition under heat of methanol in accordance with the reaction $CH_3OH \rightarrow CO + 2H_2$, said methanol being fed into said mixture.

6. A process according to claim 1, wherein, in the case of a carbo-nitriding operation, said atmosphere is produced by admixing ammonia in a proportion of 0.1 to 30% by volume, apart from the aforesaid carrier gas, hydrocarbon and carbon monoxide.

7. The process for the heat treatment of steel within a furnace, according to claim 1, wherein said forming step includes forming a mixture consisting essentially of a carrier gas, an active gas and carbon monoxide, said carrier gas including nitrogen and having a proportion of $O_2$ less than 10 ppm, a proportion of $H_2O$ less than 10 ppm and a proportion of $CO_2$ less than 10 ppm, said active gas containing a hydrocarbon in a volumetric proportion between 0.2 and 30 percent of the mixture, selected from the group of compounds consisting of $CH_4$, $C_4H_{10}$, $C_3H_8$, $C_2H_4$, $C_2H_2$ and $C_2H_6$, and said carbon monoxide being present in the mixture in a volumetric proportion between 0.1 and 30 percent.

8. The process for the heat treatment of steel within a furnace, according to claim 1, wherein said forming step includes forming a mixture of a carrier gas, an active gas and carbon monoxide, said mixture being free of $O_2$, $H_2O$ and $CO_2$, except for said carrier gas which includes nitrogen and has a proportion of $O_2$ less than 10 ppm, a proportion of $H_2O$ less than 10 ppm, and a proportion of $CO_2$ less than 10 ppm, said active gas containing a hydrocarbon in a volumetric proportion between 0.2 and 30 percent of the mixture, selected from a group of compounds consisting of $CH_4$, $C_4H_{10}$, $C_3H_8$, $C_2H_4$, $C_2H_2$ and $C_2H_6$, and said carbon monoxide being present in the mixture in a volumetric proportion between 0.1 and 30 percent.

* * * * *